United States Patent [19]

Ostrea

[11] Patent Number: 4,710,361

[45] Date of Patent: Dec. 1, 1987

[54] GOLD RECOVERY BY SULHYDRIC-FATTY ACID FLOTATION AS APPLIED TO GOLD ORES/CYANIDATION TAILINGS

[76] Inventor: Antonio M. Ostrea, 19 Istanbul Street, Merville Park Subdivision, Paranaque, Metro Manila, Philippines

[21] Appl. No.: 848,326

[22] Filed: Apr. 2, 1986

Related U.S. Application Data

[63] Continuation of Ser. No. 665,341, Oct. 26, 1984, abandoned, which is a continuation-in-part of Ser. No. 566,810, Dec. 29, 1983, abandoned.

[51] Int. Cl.[4] ..... C22B 7/00

[52] U.S. Cl. ..... 423/26; 423/29; 423/30; 423/31; 209/166; 209/167; 252/61; 75/2; 75/105; 75/106; 75/118 R

[58] Field of Search ..... 209/166, 167; 252/61; 75/118 R, 105, 2, 106; 423/26, 29, 30, 31

[56] References Cited

U.S. PATENT DOCUMENTS

| | | | |
|---|---|---|---|
| 1,291,824 | 1/1919 | Gahl | 423/26 |
| 2,838,369 | 6/1958 | Gaudin et al. | 209/166 |
| 4,441,993 | 4/1984 | Howald | 423/29 |

*Primary Examiner*—D. John Doll
*Assistant Examiner*—Robert L. Stoll
*Attorney, Agent, or Firm*—Hammond & Littell, Weissenberger & Dippert

[57] ABSTRACT

Gold values are obtained from gold cyanidation tailings or gold bearing ores by treating the same with a flotation collector consisting of 5 to 20% xanthate collector and 80 to 95% fatty acid collector of a pulp pH range from 5 to 8.

4 Claims, 2 Drawing Figures

GOLD RECOVERY BY SULHYDRIC-FATTY ACID FLOTATION AS APPLIED TO GOLD ORES/CYANIDATION TAILINGS

This application is a continuation of Ser. No. 665,341, Oct. 26, 1984, abandoned, which is a continuation-in-part of application Ser. No. 566,810 filed Dec. 29, 1983 and now abandoned.

SUMMARY OF THE INVENTION

The invention relates to an improved flotation process of recovering residual gold values from the tailings of gold cyanidation operations and from similar gold bearing ores. It involves the utilization of collecting agent combinations consisting of sulhydric and fatty collectors.

The invention has been applied to a typical gold tailings material containing 0.6 to 1.0 gram Au/MT which resulted in a gold recovery of 95%. Subsequent cleaner (upgrading) operation produced a final concentrate with a grade of 4.8 gram to 7.2 Au/MT at a substantial gold recovery of 89%.

Among other things, of great significance (and this is undersocred) is the consistency in the high recovery levels observed for the process despite changes in the grade (gold content) of the material being treated.

BRIEF DESCRIPTION OF THE DRAWING

FIGS. A and B, the appended drawings are schematic representations of embodiments of the invention.

DETAILED DESCRIPTION OF THE INVENTION

Figure 1:
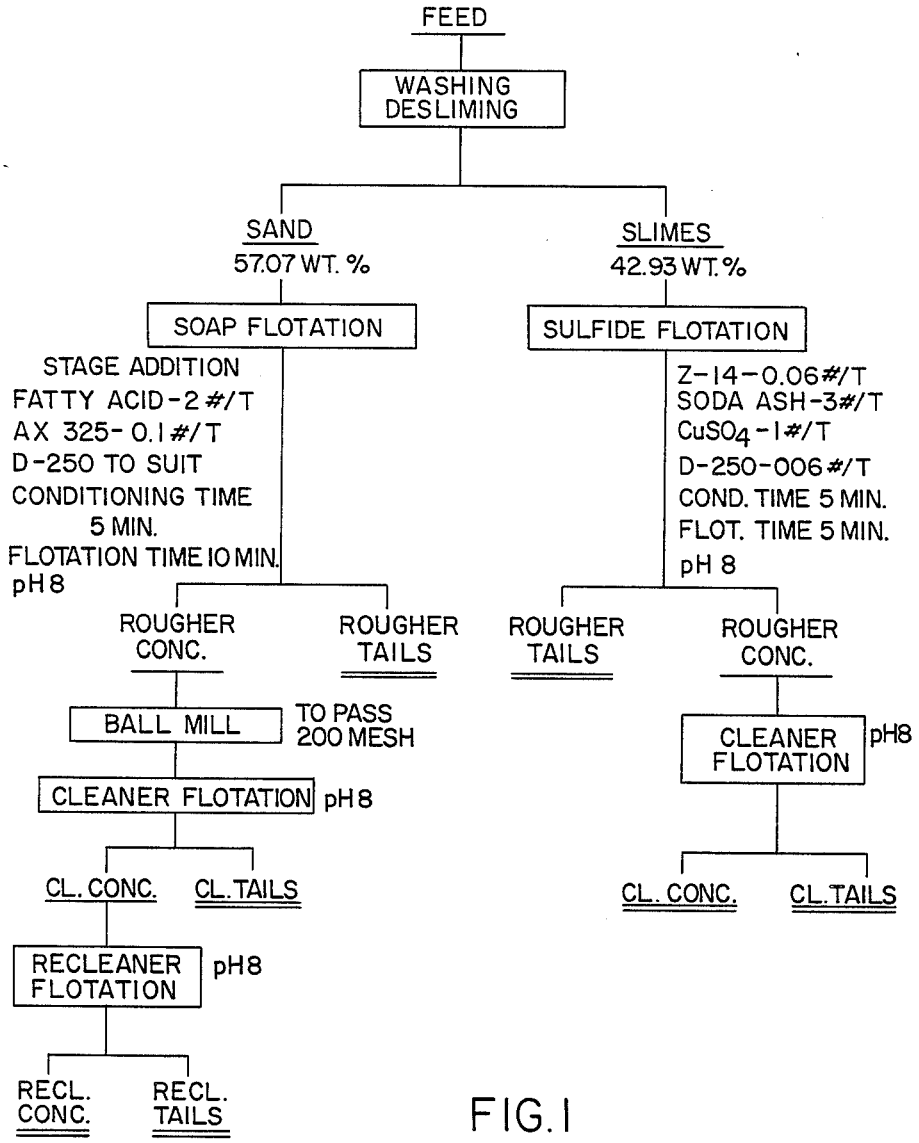
Figure 2:
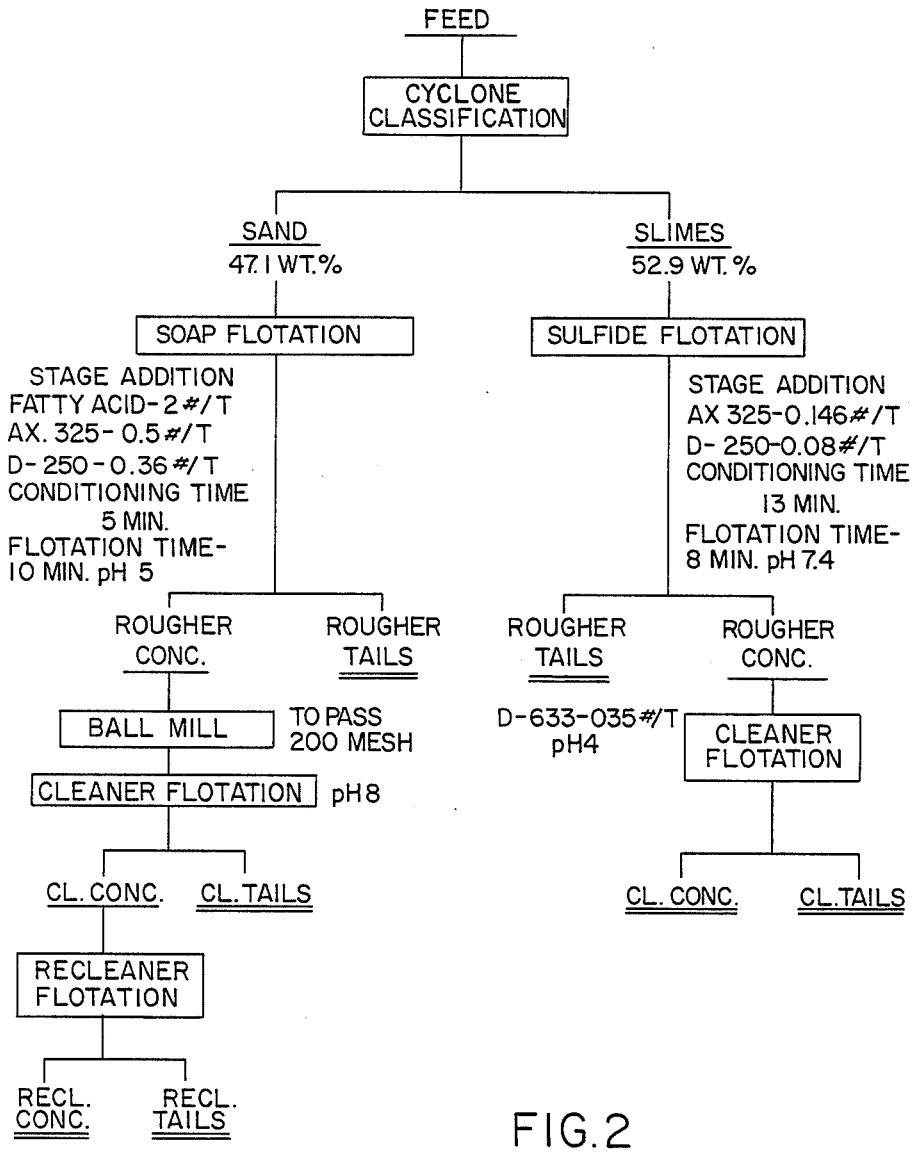

The major objective of the present invention is the provision of an improved flotation process of recovering residual gold values from the tailings of gold cyanidation operations and from similar gold bearing ores. The process utilizes a sulfhydric-fatty acid collector combination effectively to float gold-bearing minerals present in the material. From a material containing 0.6 to 1.0 grams Au/MT, a gold recovery of 89% can be realized at a concentrate grade of 4.8 gram to 7.2 gram Au/MT.

A cumulative analysis and evaluation of previous investigations in addition to the present experimental data (superpanner, tabling and sulfide flotation data) point to the fact that only limited gold recoveries can be achieved by gravity and sulfide flotation concentrations, owing to the extremely fine dispersion of the residual gold values on the different mineral associations between it, the sulfides and the non-sulfide gangue such as carbonate and silicates.

Mineralogical examination and chemical assay of the mineral as well as beneficiation products confirmed that about 30% of the gold is associated with the carbonate component, 48% with the sulfides and the balance is either free or associated with the silicates.

It might also be added that in addition to confirmed association between gold, pyrite, silicates and carbonates, several aspects of this association were revealed by the test results: the presence of a relatively gold-free iron component (pyrite essentially) and that of a gold-bearing but pyrite-free carbonate particle component in which the gold locked therein is of a very fine size and thinly distributed. The latter gold-bearing particles normally will defy upgrading by sulfide flotation, and this is believed to be the main reason why previous investigations failed to recover gold values exceeding 60%.

In order therefore to recover efficiently the gold values by flotation from such material composed of various types of gold bearing minerals having different flotabilities, it is necessary to adopt adequate flotation conditions in accord with the floatability of each gold bearing mineral particles.

In other words, the present invention is based on the novel knowledge gained by the present inventor that silicate and carbonate gold-bearing mineral particles, which exhibited upgrading difficulties as experienced by previous researchers, are amenable to flotation through the use of proper collecting agents and processing techniques.

The invention relates to a flotation process of upgrading residual gold values from the tailings of gold cyanidation operations and from similar gold-bearing ores. It involves the utilization of a sulfhydric-fatty acid reagent combination as collector or promoter of the gold present in the material as free gold, gold-bearing sulfides, gold-bearing silicates and gold-bearing carbonates. The process developed demonstrates the feasibility of obtaining more than 89% recovery of gold values through the application of a sulfhydric-fatty acid collector combination, which is generically referred to as soap flotation.

The process developed consists of flotation feed (90% passing 65-mesh) fractionation into sand (+200-mesh) and slimes (−200 mesh) portions (due to unmangeable froth produced during soap flotation of a full size range pulp). The sand portion is subjected to soap flotation (using sulfhydric-fatty acid combination as collector) and the slimes portion to sulfide flotation (using sulfhydric collector).

Suitable sulfhydric collectors are termed xanthates and are readily available commercially under the tradename AERO xanthates from American Cyanamide Co. Examples of these products are AERO 325 xanthate (sodium ethyl xanthate, herein also abbreviated as AX325) and AREO 317 xanthate (sodium isobutyl xanthate). Sodium isobutyl xanthate is also obtainable under the designation Z-14 from Dow Chemical Co.

Suitable fatty acid collectors are also readily available commercially as the 700 series of AERO Promoters, available from American Cyanamid, and include AERO Promoters 710, 723, and 765. These products are fatty acid compositions containing oleic and linoleic acids along with rosin acids, the proportions of particular acids varying depending on the specific Promoter. In the examples and tables (Ia and IIIa) which follow, the "Fatty Acid" referred to is in fact AERO 723 Promoter.

As has been determined experimentally the percentage range of reagent combination used is from 5% to 20% of sulfhydric collector and 80% to 95% of fatty acid collector depending among other things on the alkalinity-acidity of flotation pulp. The total amount of collector dosage is from 0.5 to 3 lbs./MT of material. The pH range in which the sulfhydric-fatty acid collector work so well, based on the material treated is from pH 5 to pH 8.

Specifically, Balatoc Cyanidation Tailings (from Benguet Corporation Gold Cyanidation Operation at Balatoc, Baguio District) as it comes fresh from the tailings stream has a pH of 11 more or less, so it is advisable to do flotation treatment at alkaline medium.

An example embodying the method of the invention is as follows:

A composite sample was obtained from hourly cuttings for one-week of the Balatoc mill tailings stream. On the basis of the freshest sample measured, the operating pH of the mill is seen to be in the region of pH 11. Analysis of the representative sample indicated that the material contained 0.98 gram Au/MT.

As indicated in FIG. A, a test sample was obtained and fractionated by washing and desliming to produce a sand and a slimes fraction. The sand portion, which was 57.07% of total, was charged to a laboratory flotation machine. The pulp pH adjusted to 8 with lime (pulp pH was reduced to less than 8 as a result of desliming and washing procedure), conditioned with sulfhydric-fatty acid collector and frother added in stages over a 5 minutes period, and the mineral laden froth skimmed off over a 10 minute period.

The rougher concentrate produced was ground in a laboratory ball mill at 100% passing 200-mesh, and the resulting ground pulp was cleaned floated, twice. Table 1a indicates the process of flotation as well as the reagent dosages, whereas Table IIa indicates the corresponding test results.

The slimes portion, which was 42.93% of total dried material, was subjected to sulfide flotation treatment. The pulp pH was adjusted to 8 with soda ash, conditioned for 3 minutes with $CuSO_4$ (sulfide mineral activator) and Z-14 as promoter and for another 2 minutes after adding D-250 as frother, and then the froth was skimmed off for a period of five minutes.

Subsequently, the rougher concentrate was cleaned floated for a period of five (5) minutes. The test procedure is indicated in Table 1b and the test results in Table IIb.

The consolidated sand and slimes metallurgical test results as tabulated in Table IIc.

On the other hand, the same cyanidation tailings which is being impounded in a tailings pond will undergo a process of rain washing and natural oxidation (sulfide mineral essentially) forming sulfate ion, which has a tendency to make the pulp acidic. Flotation treatment therefore on this occasion should be undertaken preferably in acidic medium. The pH of the material used in this experiment is 5 as shown in Table IIIa.

In this example the process procedure is shown in FIG. B. To produce sand and slimes fractions the sample was classified in a cyclone. This was to simulate the possible sand-slimes classification in a commercialize operation.

Experimental procedures are indicated in Tables IIIa and IIIb and the corresponding test results are indicated in Tables IVa, IVb, IVc, IVd and IVe.

TABLE Ia

Test Procedure - Soap Flotation for Sand Fraction

| Process | Reagents, lb/MT of Feed: Xanthate | Fatty Acid | D-250 | Lime | pH | Time min. |
|---|---|---|---|---|---|---|
| BULK FLOTATION | | | | | | |
| Condition | 0.05 | 1.0 | / | / | 8 | 3 |
| 1. Roughing | | | | | 8 | 5 |
| Conditioning | 0.025 | 0.5 | / | / | 8 | 1 |
| 2. Roughing | | | | | 8 | 3 |
| Conditioning | 0.025 | 0.5 | / | / | 8 | 1 |
| 3. Roughing | | | | | 8 | 2 |
| CLEANER FLOTATION | | | | | | |
| Grinding of rougher concentrate to 100% minus 200 mesh | | | | | | |
| Cleaning | | | | | 8 | 5 |
| Recleaning | | | | | 8 | 5 |
| TOTAL | 0.10 | 2.0 | | | | 25 |

TABLE Ib

Test Procedure - Sulfide Flotation of Slime Fraction

| Process | Reagents, lb/MT of Feed: Z-14 | D-250 | $CuSO_4$ | Soda Ash | pH | Time min. |
|---|---|---|---|---|---|---|
| BULK FLOTATION | | | | | | |
| Conditioning | 0.06 | | 1.0 | 3 | 8 | 3 |
| | | 0.06 | | | | 2 |
| 1. Roughing | | | | | | 5 |
| CLEANING FLOTATION | | | | | | |
| Cleaning | | | | / | 8 | 5 |
| TOTAL | 0.06 | 0.06 | 1.0 | 3+ | | 15 |

METALLURGICAL TEST RESULTS

TABLE IIa

Soap Flotation Test Data - Sand Fraction

| Product | Wt. % Yield | Assay Au, gm/MT | % Au Distribution |
|---|---|---|---|
| Soap recleaner conc. | 16.96 | 6.72 | 86.96 |
| Soap recleaner tails | 2.24 | 2.57 | 4.42 |
| Soap cleaner tails | 19.17 | 0.14 | 2.06 |
| Soap rougher tails | 61.63 | 0.16 | 6.56 |
| Calculated head | 100.00 | 1.311 | 100.00 |

TABLE IIb

Sulfide Flotation Test Data - Slime Fraction

| Product | Wt. % Yield | Assay Au, gm/MT | % Au Distribution |
|---|---|---|---|
| Sulfide cleaner conc. | 5.45 | 9.30 | 95.61 |
| Sulfide cleaner tail | 14.88 | 0.15 | 4.39 |
| Sulfide rougher tails | 79.67 | nil | |
| Calculated head | 100.00 | 0.228 | 100.00 |

TABLE IIc

Consolidated sand-slime Metallurgical Test Results

| Product | Wt. % Yield | Assay Au, gm/MT | % Au Distribution |
|---|---|---|---|
| Soap recleaner conc. | 9.68 | 6.72 | 66.71 |
| Soap recleaner tails | 1.28 | 2.57 | 3.37 |
| Soap cleaner tails | 10.94 | 0.14 | 1.57 |
| Soap rougher tails | 35.17 | 0.14 | 5.05 |
| Sulfide cleaner conc. | 2.34 | 9.30 | 22.32 |
| Sulfide cleaner tails | 6.39 | 0.15 | 0.98 |
| Sulfide rougher tails | 34.20 | nil | 0.00 |
| Calculated head | 100.00 | 0.97 | 100.00 |
| Combined conc. | 12.02 | 7.22 | 89.02 |

TABLE IIIa

| Test Procedure - Soap Flotation of Sand Fraction | | | | | | |
|---|---|---|---|---|---|---|
| | Reagents, lb/MT of Ore | | | | | Time |
| Process | Fatty Acid | Xanthate | D-250 | Lime | pH | mins. |
| BULK FLOTATION | | | | | | |
| Agitation | | | | | 5 | 5 |
| Conditioning | 1.0 | 0.25 | 0.20 | | 5 | 3 |
| 1. Roughing | | | | | 5 | 4 |
| Conditioning | 0.5 | 0.125 | 0.08 | | 5 | 1 |
| 2. Roughing | | | | | 5 | 3 |
| Conditioning | 0.5 | 0.125 | 0.08 | | 5 | 1 |
| 3. Roughing | | | | | | 3 |
| Grinding of Bulk Conc. to 100% minus 200 mesh | | | | | | |
| CLEANER FLOTATION | | | | | | |
| Cleaning | | | | / | 8 | 10 |
| Recleaning | | | | / | 8 | 8 |
| TOTAL | 2.0 | 0.5 | 0.38 | | | 38 |

TABLE IIIb

| Test Procedure - Sulfide Flotation of Slime Fraction | | | | | | |
|---|---|---|---|---|---|---|
| | Reagents, lb/MT of Ore | | | | | |
| Process | AX-325 | D-250 | D-633 | $H_2SO_4$ | pH | Time mins. |
| BULK FLOTATION | | | | | | |
| Conditioning | 0.096 | 0.05 | | | 7.4 | 5 |
| 1. Roughing | | | | | | 3 |
| Conditioning | 0.05 | 0.03 | | | | 8 |
| 2. Roughing | | | | | | 5 |
| CLEANER FLOTATION | | | | | | |
| Conditioning | | | 0.35 | / | 4 | 15 |
| Cleaning | | | | | | 9 |
| TOTAL | 0.146 | 0.08 | 0.35 | | | 45 |

METALLURGICAL TEST RESULTS

TABLE IVa

| Soap Rougher Flotation Data - Sand Fraction | | | |
|---|---|---|---|
| Product | Wt. % Yield | Assay Au, gm/Mt | % Au Distribution |
| Soap rougher conc. | 28.92 | 2.98 | 96.96 |
| Soap rougher tails | 71.08 | 0.038 | 3.04 |
| Calculated head | 100.00 | 0.89 | 100.00 |
| Actual head assay | | 0.81 | |

TABLE IVb

| Soap Cleaner Flotation Data - Sand Fraction | | | |
|---|---|---|---|
| Product | Wt. % Yield | Assay Au, gm/MT | % Au Distribution |
| Soap recleaner conc. | 19.80 | 4.13 | 92.13 |
| Soap recleaner tails | 2.72 | 0.61 | 1.87 |
| Soap cleaner tails | 6.40 | 0.41 | 2.96 |
| Soap rougher tails | 71.08 | 0.038 | 3.04 |
| Calculated head | 100.00 | 0.89 | 100.00 |
| Actual head assay | | 0.81 | |

TABLE IVc

| Sulfide Rougher Flotation Data - Slimes Fraction | | | |
|---|---|---|---|
| Product | Wt. % Yield | Assay Au, gm/MT | % Au Distribution |
| Sulfide rougher conc. | 14.32 | 2.44 | 91.49 |
| Sulfide rougher tails | 85.68 | 0.038 | 8.51 |
| Calculated head | 100.00 | 0.38 | 100.00 |
| Actual head assay | | 0.36 | |

TABLE IVd

| Sulfide Cleaner Flotation Data - Slimes Fraction | | | |
|---|---|---|---|
| Product | Wt. % Yield | Assay Au, gm/MT | % Au Distribution |
| Sulfide Cleaner conc. | 4.01 | 7.91 | 82.87 |
| Sulfide cleaner tails | 10.31 | 0.31 | 8.62 |
| Sulfide rougher tails | 85.68 | 0.038 | 8.51 |
| Calculated head | 100.00 | 0.38 | 100.00 |
| Actual head assay | | 0.36 | |

TABLE IVe

| Consolidated Sand-Slimes Metallurgical Test Results. | | | |
|---|---|---|---|
| Product | Wt. % Yield | Assay Au, gm/MT | % Au Distribution |
| Soap recleaner conc. | 9.33 | 4.13 | 62.11 |
| Soap recleaner tails | 1.28 | 0.61 | 1.26 |
| Soap cleaner tails | 3.01 | 0.41 | 1.98 |
| Soap rougher tails | 33.48 | 0.038 | 2.05 |
| Sulfide cleaner conc. | 2.12 | 7.91 | 27.03 |
| Sulfide cleaner tails | 5.45 | 0.32 | 2.80 |
| Sulfide rougher tails | 45.33 | 0.038 | 2.77 |
| Calculated head | 100.00 | 0.62 | 100.00 |
| Actual head assay | | 0.59 | |
| Combined concentrate | 11.45 | 4.83 | 89.14 |

I claim:

1. In a process of upgrading residual gold values from gold cyanidation tailings which comprises treating the said tailings by froth flotation in the presence of a combination of flotation collectors, the improvement consisting of fractionating the flotation feed (90% passing 6.5 mesh) into sand (+200 mesh) and slimes (31 200 mesh) and separately subjecting the sand portion to soap flotation using a sulfhydric-fatty acid combination as the collector, and the slime portion to sulfide flotation using sulfhydric collectors.

2. A process as recited in claim 1 wherein the sand portion is subjected to soap flotation using a flotation collector consisting of 5% to 20% sulfhydric collector and 80% to 95% fatty acid collector at a pulp pH range from 5 to 8.

3. A process according to claim 2 wherein the sulfhydric collector is sodium ethyl xanthate or sodium isobutyl xanthate and the fatty acid collector comprises oleic acid and linoleic acid.

4. A process according to claim 3 wherein the fatty acid collector includes rosin acids.

* * * * *

UNITED STATES PATENT AND TRADEMARK OFFICE

CERTIFICATE OF CORRECTION

PATENT NO. : 4,710,361

DATED : December 1, 1987

INVENTOR(S) : Antonio M. Ostrea

It is certified that error appears in the above-identified patent and that said Letters Patent is hereby corrected as shown below:

After [63] on the title page, the following should be inserted:

-- [30] Foreign Application Priority Data

-- January 14, 1983 Philippines 28,389 --

Claim 1, lines 6 and 7: "(31 200 mesh)" should read

-- (- 200 mesh) --

Signed and Sealed this

Twenty-sixth Day of April, 1988

*Attest:*

*Attesting Officer*

DONALD J. QUIGG

*Commissioner of Patents and Trademarks*